US007943877B2

(12) United States Patent
Chu

(10) Patent No.: US 7,943,877 B2
(45) Date of Patent: May 17, 2011

(54) SWITCH STRUCTURE HAVING DISPLAY AND PLAYBACK DEVICE

(76) Inventor: Gear Chu, Taipei (TW)

( * ) Notice: Subject to any disclaimer, the term of this patent is extended or adjusted under 35 U.S.C. 154(b) by 387 days.

(21) Appl. No.: 12/317,661

(22) Filed: Dec. 29, 2008

(65) Prior Publication Data

US 2010/0163387 A1 Jul. 1, 2010

(51) Int. Cl.
*H01H 9/00* (2006.01)

(52) U.S. Cl. ..... 200/310

(58) Field of Classification Search ..... 200/310, 200/237, 314, 530, 293
See application file for complete search history.

(56) References Cited

U.S. PATENT DOCUMENTS 4,987,279 A * 1/1991 Hirose et al. ..... 200/314
5,072,085 A * 12/1991 Shinohara et al. ..... 200/314
5,278,362 A * 1/1994 Ohashi ..... 200/5 A

* cited by examiner

*Primary Examiner* — Edwin A. Leon

(57) ABSTRACT

A switch structure having a display and playback device is proposed. The switch structure comprises an upper housing and a lower housing jointly enclosing therein the display and playback device that is connected to a circuit board. A resilient member is provided for supporting and positioning internal components of the switch structure. A display-and-playback-device housing has support rods provided at two sides thereof to prevent the switch structure from slanting when pressed. When a conductor and a terminal settled in the lower housing connect with or disconnect from each other, functions of opening and closing a circuit and enabling signal input are enabled. The display and playback device plays back and displays dynamic and still images to indicate functions and state of use of an equipment and enable personalized panels, thereby improving work efficiency and accuracy of operation.

3 Claims, 7 Drawing Sheets

C–C

SWITCH STRUCTURE HAVING DISPLAY AND PLAYBACK DEVICE

BACKGROUND OF THE INVENTION

1. Technical Field

The present invention relates to a switch structure having a display and playback device, wherein the switch structure utilizes a resilient member and support rods therein to position the switch structure and prevent the switch structure from slanting. In cooperation with the display and playback device provided therein, the switch structure not only provides functions of making and breaking a circuit and enabling signal input, but also serves to display and play back still or dynamic images, thereby improving work efficiency.

2. Description of Related Art

Switch structures typically serve to open and close circuits. Different switch structures are actuated by different ways, such as by pressing, rotating, and pulling. Therein, the pressing type switches are convenient to operate and thus are most popular. When integrated with plural buttons of an identical shape or different shapes, the pressing type switches allow various signals to be input to direct expected performances.

In order to facilitate signal input, conventionally, each button is marked with a simple symbol or character in its limited surface area for describing the function of the button. For instance, although devices such as keyboards for PCs and calculators, keypads of mobile phones, control panels of audio-video players, digitally controlled machine tools, and so on do contribute to our daily convenience, users have to spend a lot of time reading the related instructions and memorize the functions of individual keys or buttons before using these devices. In the modern times where technologies change with each passing day, it is common in the area of electronic products to weed through the old to bring forth the new. Thus, users have to keep learning about the operation of buttons on new products or consulting the user manuals all the while. Young users who are used to learning about new information may have little problem adapting themselves to the new devices, but children or senior people may suffer from the inconvenience. Moreover, the symbols or characters printed on the conventional buttons tend to fade away after long-term operation and finally fail to provide indication. Although in an alternative approach, those symbols or characters may be integrally formed on the buttons in the manufacturing process, such permanent indication limits the application of the buttons so that the buttons are not adaptive to various machines. While LEDs have been employed in switches on push-button panels, they only feature changeable colors and are insufficient to provide clear indication. On the other hand, regarding the pressing function of a button structure, it is required that, for a button structure to be actuated by pressing, an external force must be applied in a direction perpendicular to the surface of the button. If the external force comes bias, the button structure may have its internal components jammed and thus fail to open or close a circuit smoothly. This is especially inconvenient in an emergency. Therefore, the shortcomings of the conventional switch devices in both structure and function need to be remedied.

SUMMARY OF THE INVENTION

In view of the problems of the prior arts, the present invention provides a switch structure. The disclosed switch structure improves work efficiency by using support rods to provide an anti-slant function and incorporating a display and playback device. The switch structure comprises an upper housing and a lower housing jointly enclosing therein the display and playback device, a resilient member, a transparent member, a display-and-playback-device housing, a resilient-member socket, a conductor, and a terminal. The display and playback device is settled in the display-and-playback-device housing. The transparent member, which is located at an upper end of the upper housing, allows dynamic or still images played back and displayed by the display and play back device to be exhibited clearly therethrough. The resilient member is settled between the display-and-playback-device housing and the resilient-member socket. A circuit board, the terminal, and the conductor are settled in the lower housing. When a downward external force is applied to a button structure, the support rods push the conductor to contact the terminal so as to close a circuit. When the external force is released, the support rods are disconnected from the conductor, and the conductor returns to its initial position as to open the circuit. The two support rods are provided at a lower portion of the display-and-playback-device housing to prevent the button structure from slanting under the downward external force. When the button structure receives a downward yet biased external force, the two support rods rotate against rod retainers to counteract a horizontal component of the external force, so that the button structure is ensued with smooth vertical movement to close or open the circuit and prevented from being jammed and continuously performing erred input operations. Thus, work efficiency is effectively improved.

BRIEF DESCRIPTION OF THE DRAWINGS

The invention as well as preferred modes of use, further objectives, and advantages thereof will be best understood by reference to the following detailed description of an illustrative embodiment when read in conjunction with the accompanying drawings, wherein.

DETAILED DESCRIPTION OF THE PREFERRED EMBODIMENT

Figure 1:
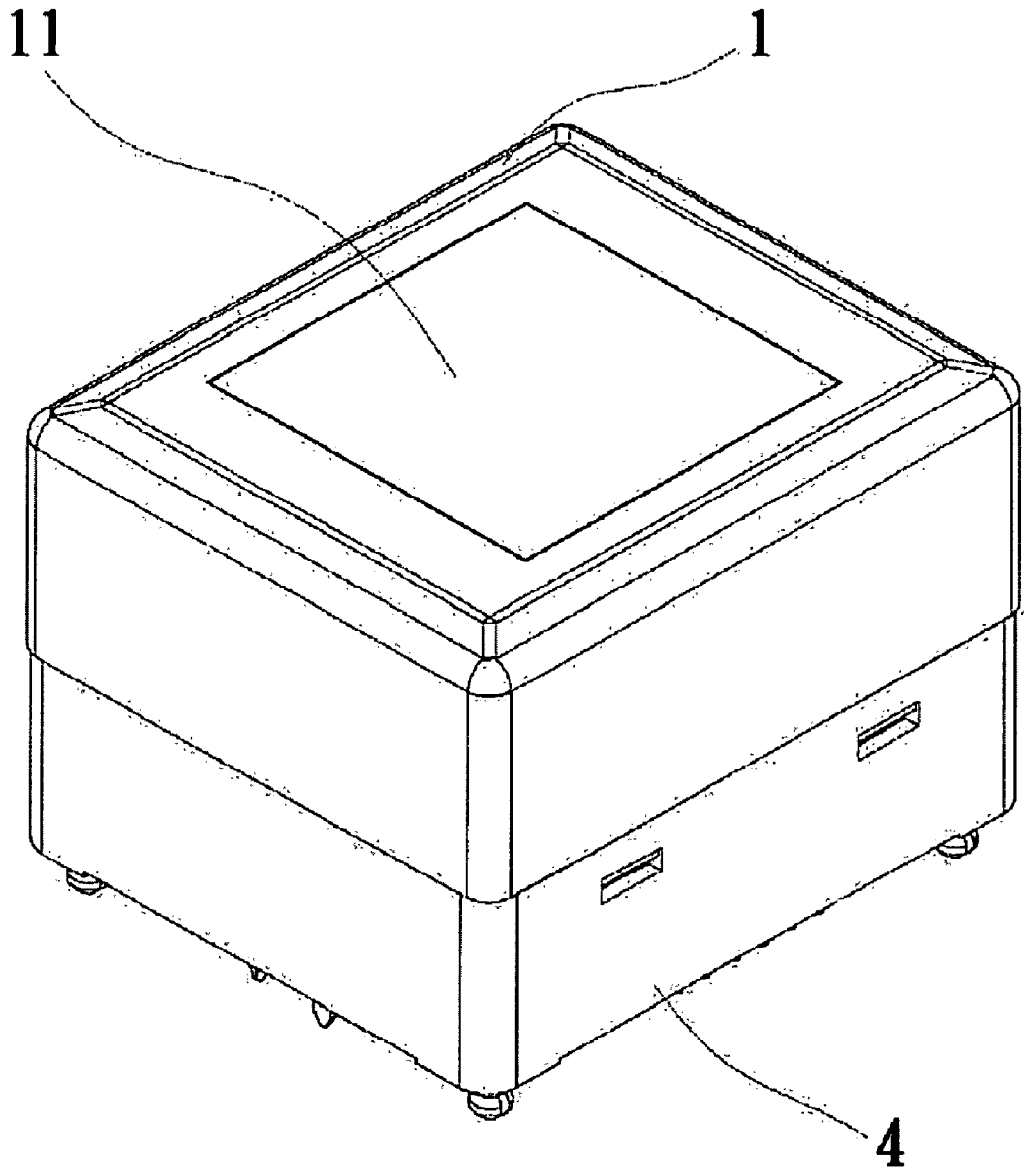
FIG. 1 is a perspective view of the present invention.
Figure 2:
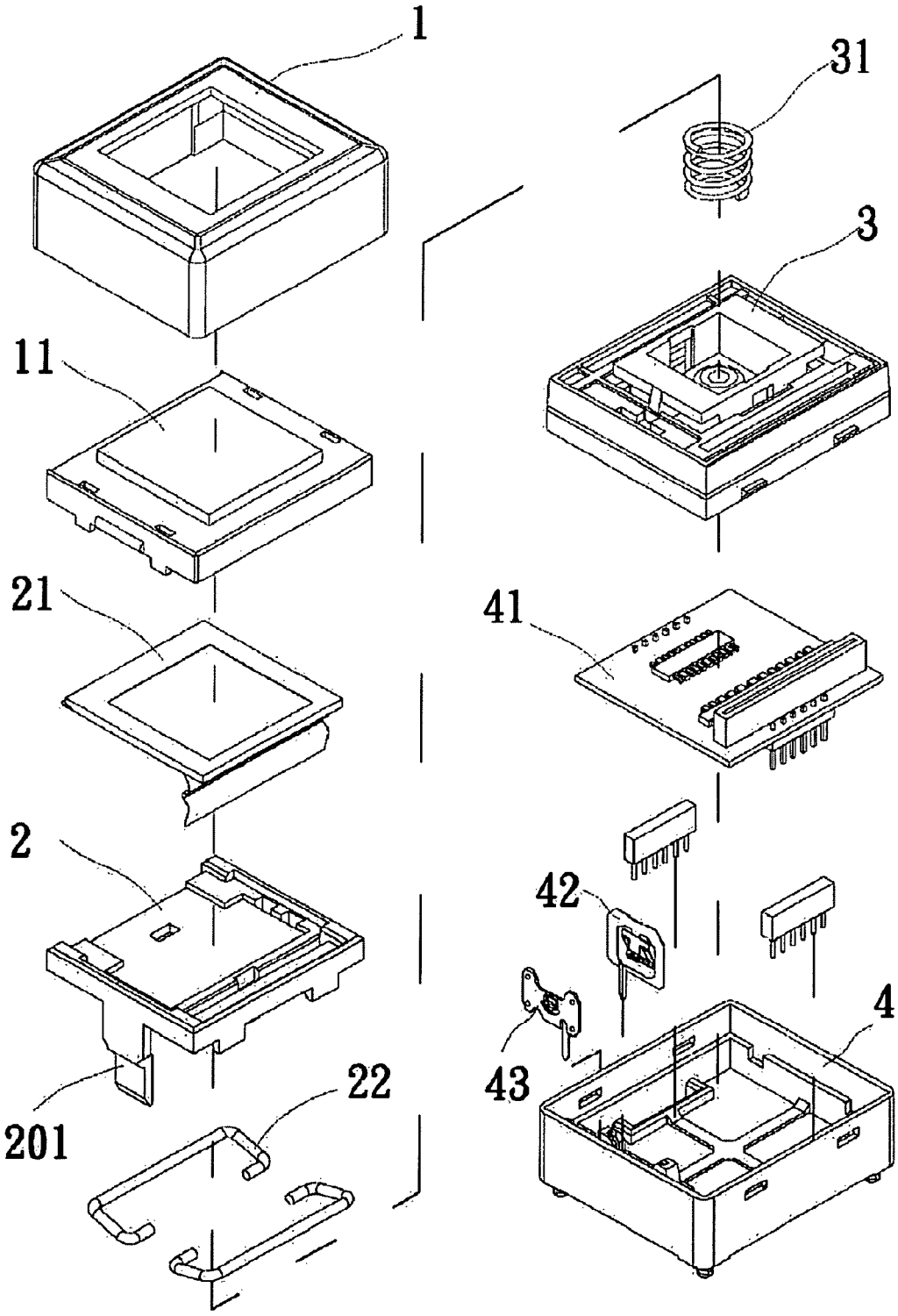
FIG. 2 is an exploded view of the present invention.
Figure 3:
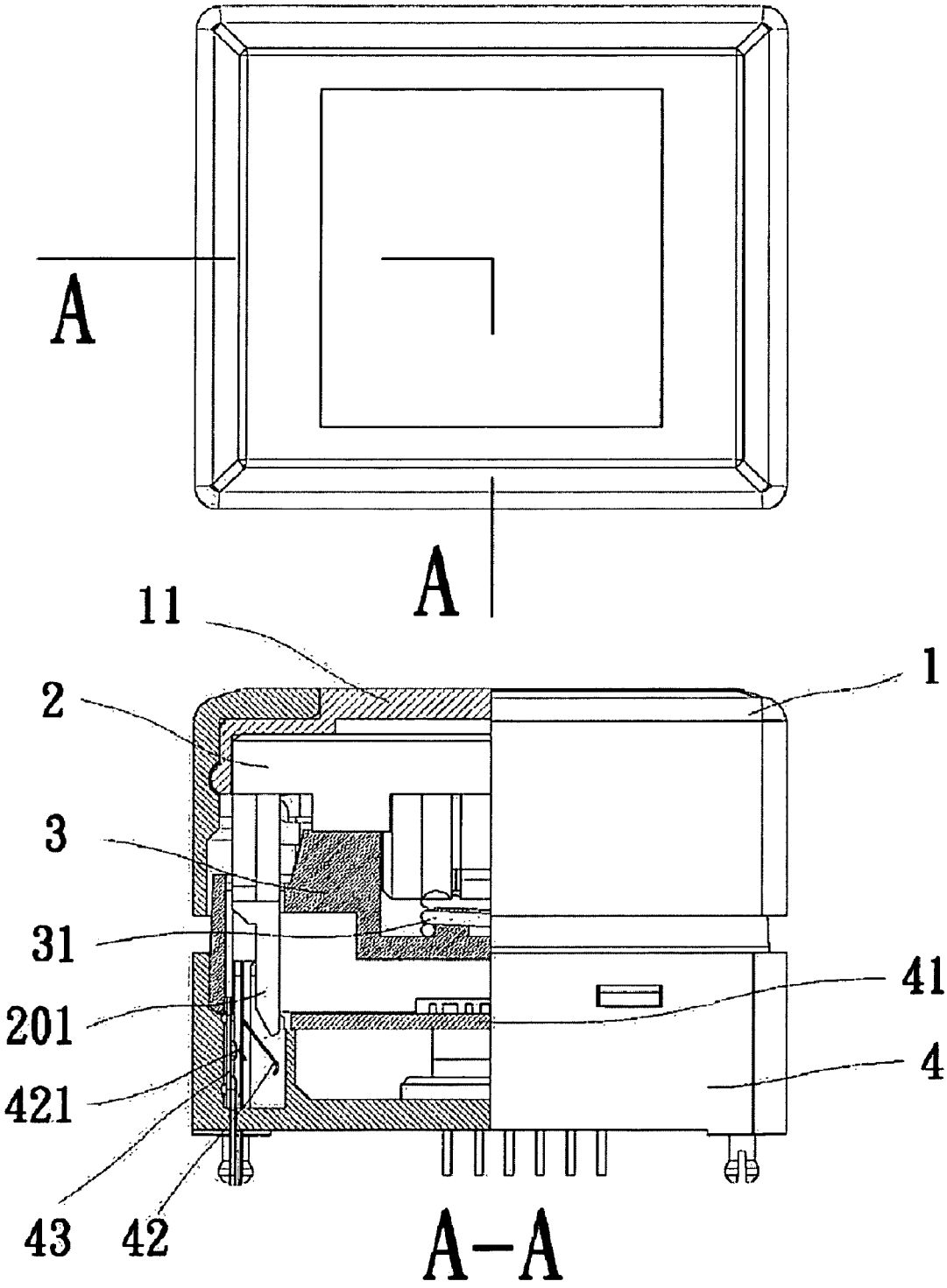
FIG. 3 is a partial cross-sectional view of the present invention taken along line A-A.
Figure 4:
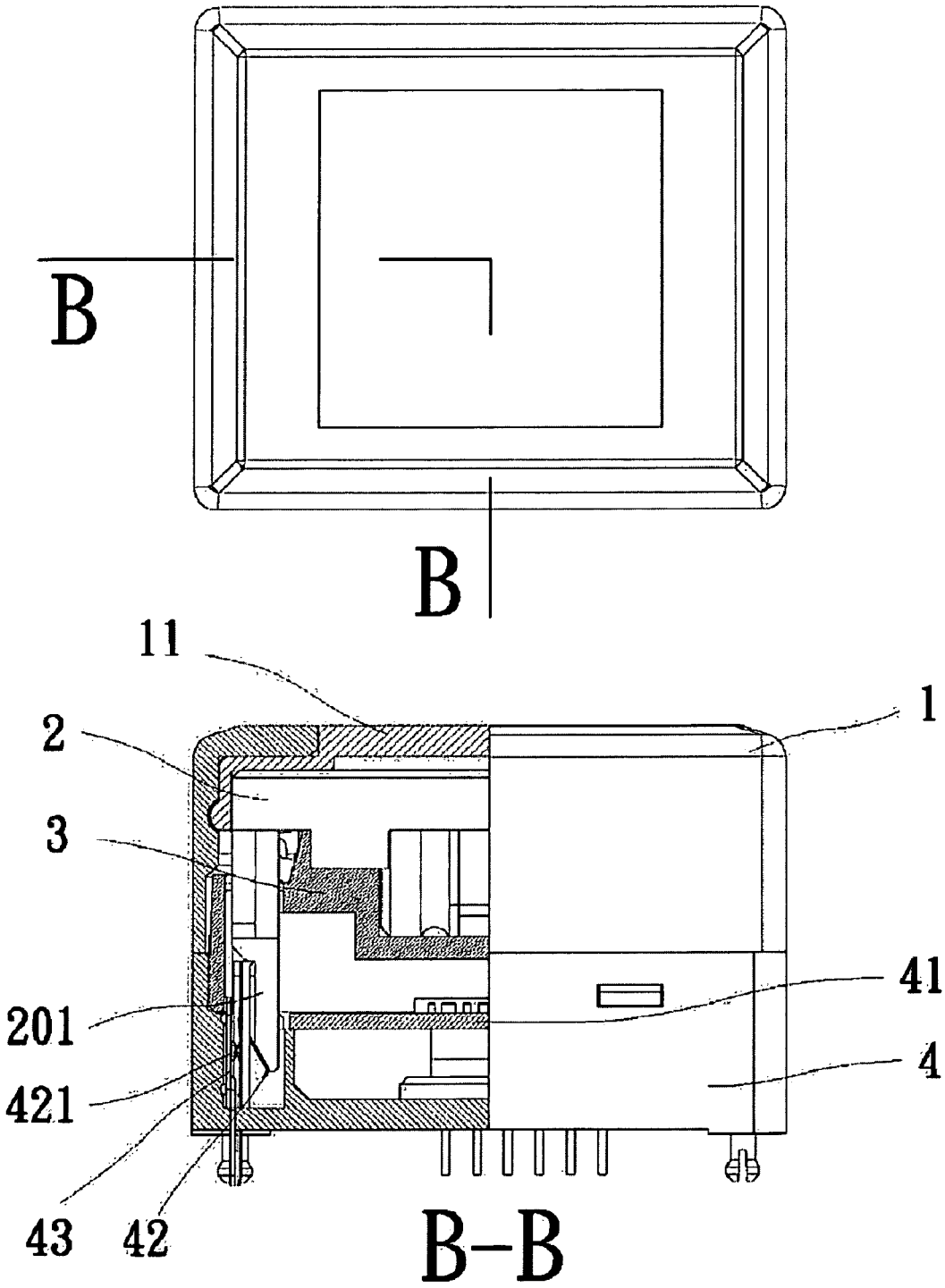
FIG. 4 is another partial cross-sectional view of the present invention taken along line B-B.
Figure 5:
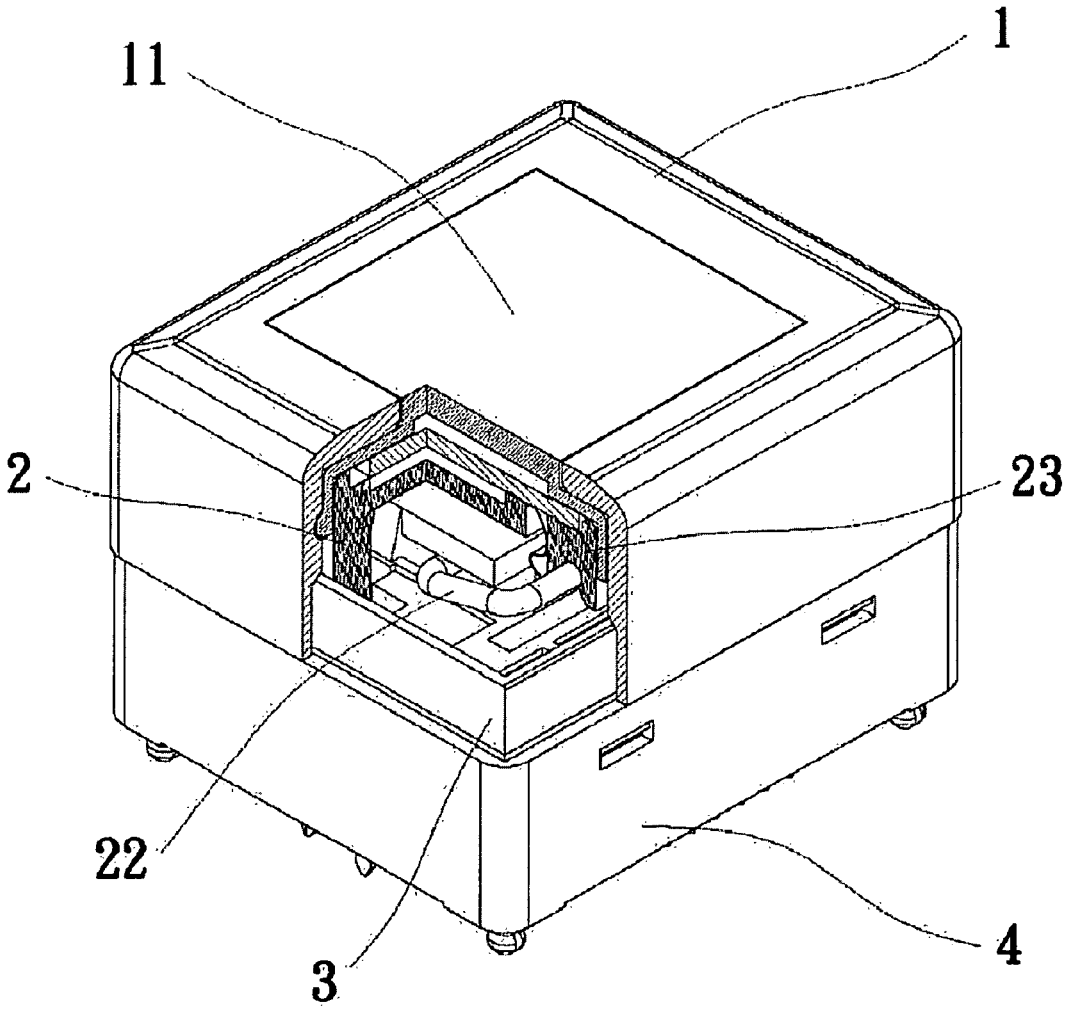
FIG. 5 is a partially removed perspective view of the present invention.
Figure 6:
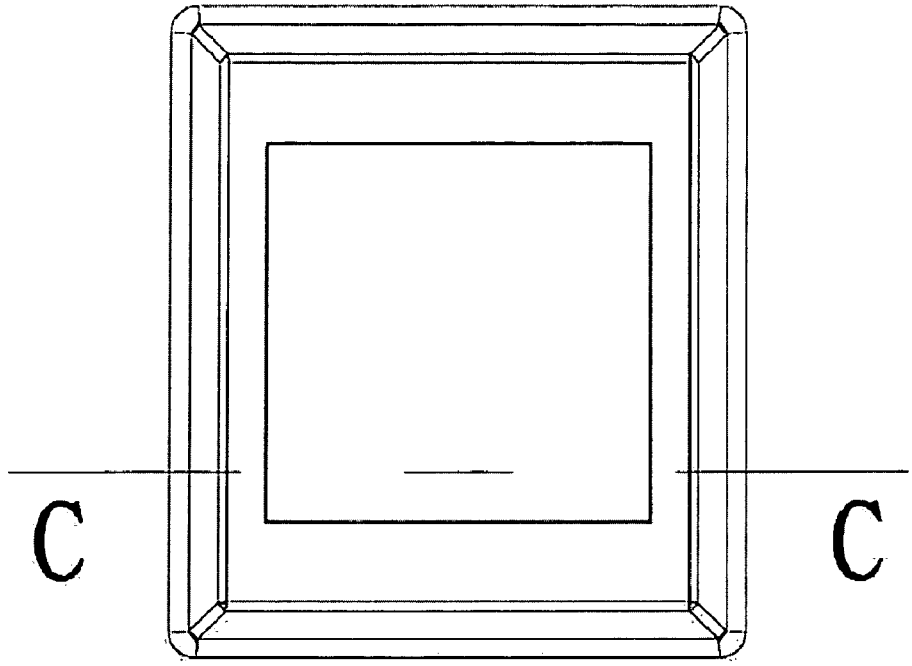
FIG. 6 is another partial cross-sectional view of the present invention taken along line C-C.
Figure 6:
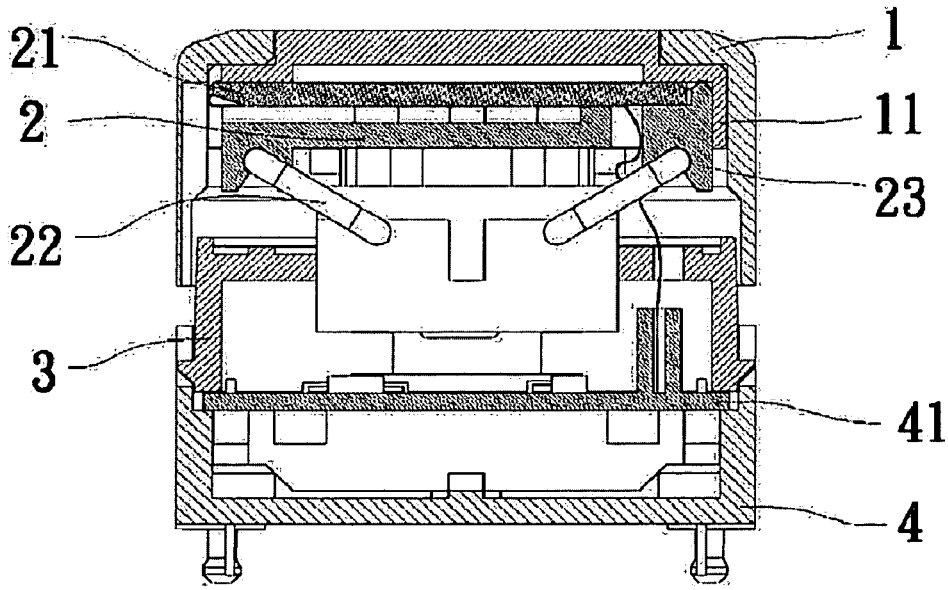
Figure 7:
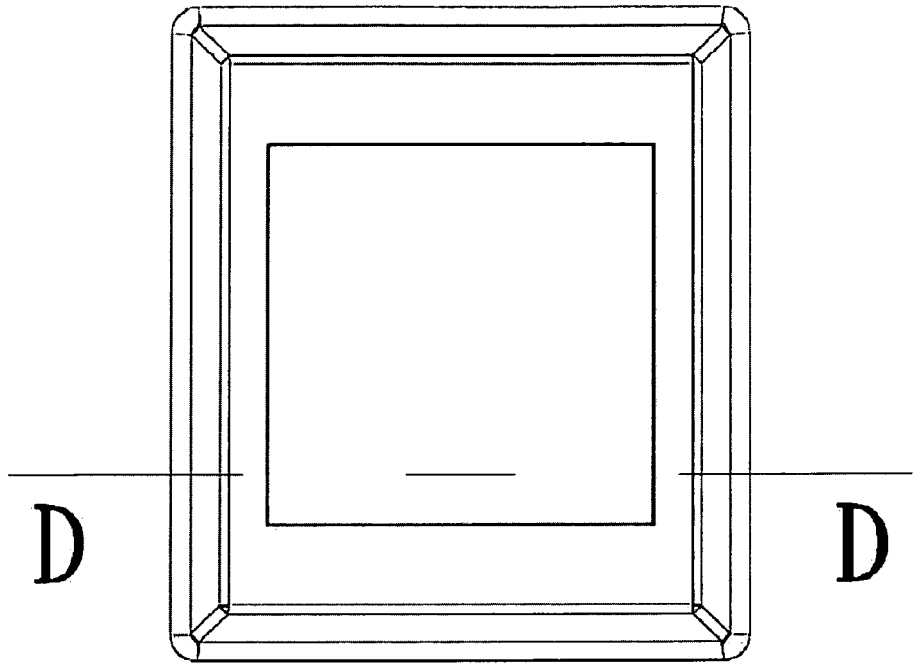
FIG. 7 is another partial cross-sectional view of the present invention taken along line D-D.
Figure 7:
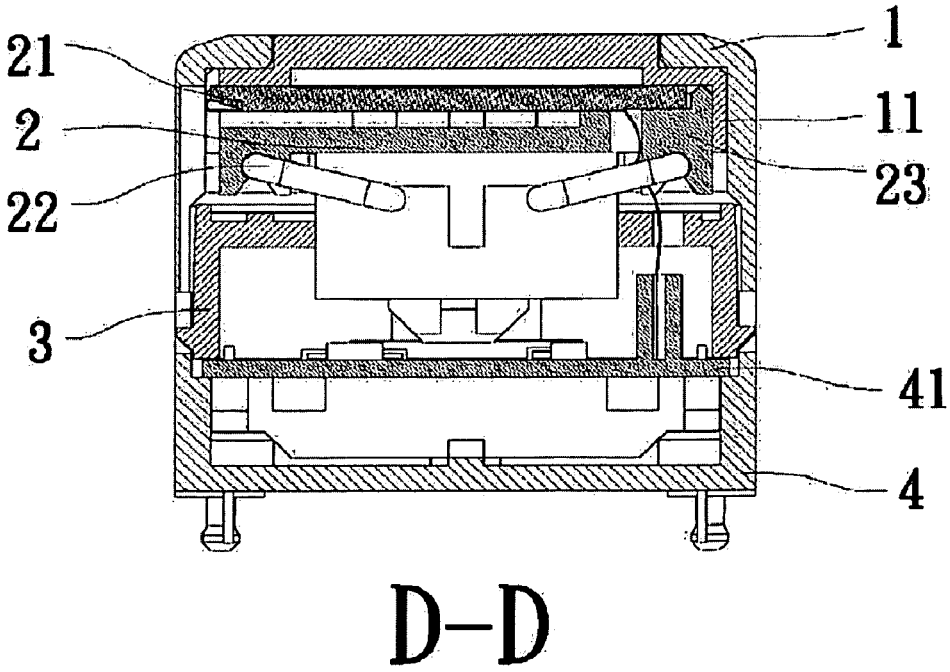

The present invention relates to a switch structure having a display and playback device. Please refer to FIGS. 1 through 7. As can be seen in the drawings, the switch structure primarily comprises an upper housing 1, a lower housing 4, a display and playback device 21, a circuit board 41, a resilient member 31, a transparent member 11, a display-and-playback-device housing 2, two support rods 22, a resilient-member socket 3, a conductor 42, and a terminal 43. The configuration of the aforementioned components will be hereinafter described with reference to FIG. 2. The display and playback device 21 is settled in the display-and-playback-device housing 2 and connected to the circuit board 41. The support rods 22 are assembled to rod retainers 23. The transparent member 11 is located at the upper housing 1. The resilient member 31 is sandwiched between the display-and-playback-device housing 2 and the resilient-member socket 3. The conductor 42 and the terminal 43 are settled in the lower housing 4. As shown in FIG. 3, when the upper housing 1 is free from any external force, the resilient member 31 is at its normal position to support the display-and-playback-device housing 2, the display and playback device 21, the transparent member 11, and the upper housing 1. At this time, an arm 201 affixed to display-and-playback-device housing 2 is in no connection with the conductor 42 so that the conductor 42 and the terminal 43 are in no connection with each other, thereby opening a circuit. Referring to FIG. 4, when a downward external force is applied to the upper housing 1, the resilient member 31 is compressed to push the arm 201 of the display-and-playback-device housing 2 downward, so that the arm 201 in turn pushes the conductor 42. Consequently, a bent portion 421 formed on the conductor 42 moves outward and comes into contact with the terminal 43, so as to close the circuit. As can be seen in FIG. 5, the support rods 22 are retained in the rod retainers 23 and are inwardly rotatable against the rod retainers 23. Referring to FIG. 7, when the downward external force comes in a biased direction, the two support rods 22 rotate inward against the rod retainers 23 to counteract the horizontal component of the external force so that a button structure is ensured with smooth vertical movement, thereby preventing jam of the button structure or continuous erred input operations.

The conductor 42 and the terminal 43 are formed independently so that the display and playback device 21 can independently provide its display and playback functions whether the circuit is open or closed. Besides, a plurality of the disclosed switch structures, of an identical shape or of different shapes, may be jointly implemented in cooperation with various circuit designs so as to conveniently switch between the display and playback functions of the switch structures. Although the present invention has been described with reference to the preferred embodiment, it is understood that the embodiment is not intended to limit the scope of the present invention. Therefore, all equivalent changes or modifications which do not depart from the concept of the present invention should be encompassed by the appended claims.

The invention claimed is:

1. A switch structure having a display and playback device, the switch structure comprising an upper housing and a lower housing jointly enclosing therein the display and playback device, two support rods, a resilient member, a circuit board, a conductor, a terminal, a transparent member, a display-and-playback-device housing and a resilient-member socket; the transparent member located at the upper housing for allowing dynamic and still images played back and displayed by the display and playback device to be exhibited therethrough; the display and playback device settled in the display-and-playback-device housing for playing back and displaying the dynamic and still images; the resilient member settled in the resilient-member socket; the conductor settled in the lower housing; the terminal settled in the lower housing;

the display-and-playback-device housing having a lower portion provided with rod retainers and an arm; the two support rods retained by the rod retainers at the lower portion of the display-and-playback-device housing; the circuit board settled inside the upper and lower housings and connected to the display and playback device; and the resilient-member socket receiving the resilient member therein; the switch structure being characterized in that: when a biased downward external force is applied to the upper housing, the resilient member is compressed, and the support rods rotate against the rod retainers to counteract a horizontal component of the external force so as to ensure smooth vertical movement of the switch structure.

2. The switch structure of claim 1, wherein the conductor and the terminal are independent components.

3. The switch structure of claim 1, wherein the conductor and the terminal are capable of switching functions of the display and playback device.

* * * * *